US005900180A

United States Patent [19]

Scott et al.

[11] Patent Number: 5,900,180

[45] Date of Patent: May 4, 1999

[54] DISPOSABLE LAYOUT FORM LINER FOR STRUCTURES

[76] Inventors: Samuel C. Scott, 4575 Joliet St., Denver, Colo. 80209; Mark Allison Scott, 4575 Joliet St., Denver, Colo. 80239

[21] Appl. No.: 08/510,786

[22] Filed: Aug. 3, 1995

[51] Int. Cl.[6] ..... B28B 7/34

[52] U.S. Cl. ..... 249/61; 249/83; 249/96; 249/97; 52/315; 52/314

[58] Field of Search ..... 249/83, 96, 97, 249/61; 52/314, 315

[56] References Cited

U.S. PATENT DOCUMENTS

| | | | |
|---|---|---|---|
| 2,122,696 | 7/1938 | Poston | 52/315 |
| 2,465,871 | 3/1949 | Hardie et al. . | |
| 2,825,221 | 3/1958 | Brouk . | |
| 3,131,514 | 5/1964 | Siek . | |
| 3,359,354 | 12/1967 | Johnson . | |
| 3,594,968 | 7/1971 | Johnson . | |
| 3,602,476 | 8/1971 | Iragorri | 249/96 |
| 3,629,384 | 12/1971 | Elgenstierna . | |
| 3,868,801 | 3/1975 | Weiner . | |
| 3,892,380 | 7/1975 | Anderson | 249/83 |
| 4,031,682 | 6/1977 | Renkert . | |
| 4,644,719 | 2/1987 | Salazar . | |
| 5,268,137 | 12/1993 | Scott et al. | 249/96 |
| 5,502,941 | 4/1996 | Zember et al. | 52/315 |

FOREIGN PATENT DOCUMENTS

| | | |
|---|---|---|
| 2839704 | 3/1980 | Germany . |
| 491397 | 9/1938 | United Kingdom . |

OTHER PUBLICATIONS

Ceramic Tile Installation Methods—Practiced in Japan (Publication date unknown).

*Primary Examiner*—David W. Wu
*Attorney, Agent, or Firm*—Pittenger & Smith, P.C.

[57] ABSTRACT

A disposable object form line for use in horizontal casting of building panels from settable material in which at least one side has an exposed face of embedded objects. The object form liner is comprised of a thin support sheet having an adhesive coating on one side. A closed cell plastic grid having ridges which define openings sized to fit the outer perimeter of the intended objects is provided. The grid is adhered to the adhesive coating on the support sheet. Retarder strips may be inserted in each opening to prevent contamination of the face of the object during the pouring process. The form liner is placed in the bottom of a horizontal mold. The objects, such as bricks, are positioned in the openings provided in the layout form liner and the settable material is poured into the mold to form a construction panel. After setting, the panel and disposable form liner are removed from the mold and the liner is stripped from the panel to expose the objects embedded in the surface.

28 Claims, 5 Drawing Sheets

DISPOSABLE LAYOUT FORM LINER FOR STRUCTURES

FIELD OF THE INVENTION

This invention is directed to a disposable grid for horizontally forming and pouring an object embedded wall or panel. It is more specifically directed to a disposable brick layout form liner having a plurality of recesses for properly positioning objects in a horizontal mold for casting a settable material so as to embed and expose a surface of the objects in the surface of the finished structure.

BACKGROUND OF THE INVENTION

Over the years there has been a number of solutions that have been tried to resolve the many problems that are encountered in the construction of walls and panels using concrete and other settable materials. A bare, exposed concrete wall is esthetically boring and displeasing to the eye. For this reason, a number of methods have been proposed to texture or provide a surface finish to the outer surface of concrete structures to provide an architecturally pleasing appearance.

As a result of these proposals, different arrangements have been tried to adhere or embed articles within the surface of the structure or to texture the surface of the finished concrete structure with varying degrees of success. As is well known in the prior art, different methods have also been attempted to hold bricks and other objects within a concrete mold, usually positioned horizontally, while the concrete is poured over the objects so as to embed and hold the objects in the surface of the finished concrete panel. The panels are then assembled for constructing the finished wall. While in many cases bricks have been used as the surface treatment, other objects can be used, such as tiles, blocks, stones or the like which provide a visually pleasing appearance.

Many of the prior art solutions have been quite expensive and cost prohibitive which eliminates them as a viable solution. In addition, the prior art forms and molds do not seal the face surface of the object from concrete grout seepage creating a considerable additional labor cost for cleaning the exposed surface of the finished wall or panel.

In order to eliminate many of these existing problems, it is desirable to provide a lightweight layout form liner product which will securely position objects and allow these objects to be held in the mold without shifting during the pouring of the settable medium. An additional aspect of the novel approach which is addressed in the present invention is the ability to seal or neutralize any seepage that might get to the face surface of the object. These two attributes are in direct correlation to each other and this is why the present invention is so innovative and unique.

INFORMATION DISCLOSURE STATEMENT

The following information is provided in compliance with the inventors' duty to disclose all pertinent information which is relevant to the examination of the subject application. The patents are known to the applicants and are believed to be pertinent. It is not to be assumed that this list is all inclusive of any search which may have been performed for or by the applicants. In addition, it is possible that other patents may have been considered by the applicants and these items are not believed pertinent and of concern with respect to the examination and patentability of this invention.

The Iragorri patent (U.S. Pat. No. 3,602,476) discloses an elastomeric template which is formed with recesses having surrounding edges. The recesses form a lattice for retaining bricks to simulate brick construction in a conventional masonry wall. The lattice ridges form the grout lines between the bricks and also serve to hold the bricks in place. The horizontal template provided by Iragorri is a one step device for holding the bricks in position to form a mold for a conventional concrete building panel. The template is quite heavy to handle and expensive to manufacture. This disclosure is contrary to the present invention in that the form liner disclosed in the present application is an inexpensive, lightweight, disposable liner which is intended to be used only once in the production of a brick simulated concrete wall or panel.

The Renkert patent (U.S. Pat. No. 4,031,682) discloses a method of making a building panel using a form fabricated from a one-piece plastic shell including longitudinal and transfers ridges to serve as indicia to indicate where the facing bricks are located. The ridges are said to minimize migration of grout to the front surface of the finished panel. The ridges are the only method that is disclosed to prevent the migration of the grout to the front face surfaces of the bricks. A settable medium is poured into the mold and reinforcing is immersed in the medium prior to setting and an insulation layer is applied to the back of the panel after the material has set. This patent is directed to the manufacture of a complete insulated building panel and the mold itself is a small portion of the overall disclosure. There is no provision other than the disclosed ridges for sealing the bricks and preventing the seepage of grout to the front face of the bricks or objects. In addition, there is no disclosure in this patent of the use of a one time disposable lightweight form.

The Siek patent (U.S. Pat. No. 3,131,514) discloses the construction of a thin precast wall panel. Small plate-shaped elements are fixed on a sheet of paper or a web of fabric by cementing and then inserted into a mold. The mold is used to cast the wall panel with the elements embedded in the exposed surface of the panel. The elements can be bricks or tiles. The molding is performed in the horizontal position.

The Brouk patent (U.S. Pat. No. 2,825,221) discloses a mold pan for forming a simulated masonry panel. The mold pan disclosed in this patent is merely an open, flat, horizontal, metal pan in which individual bricks are spaced across the bottom to simulate their normal position in a masonry wall. This patent states that suitable spacers may be used to assure uniform spacing of the bricks within the finished panel. There is no disclosure in this patent of the use of a layout form liner for properly positioning the bricks or objects and sealing the face of the objects from contamination by the grout or settable medium.

The Hardie et al. patent (U.S. Pat. No. 2,465,871) discloses a molding process for vertical wall construction which utilizes a plurality of strips laid out vertically and horizontally to form rectangular recesses into which facing units are inserted. The facing unit is a special type of object simulating a brick face which has an elongated tongue extending along the back surface. A wire mesh retainer is positioned in contact with the tongue to hold the units in place in the recesses when the mold is raised into the vertical position. The strips are provided merely to form a spacer between the individual units during the pouring process. There is no provision in this patent for sealing the edges of the unit and preventing the concrete grout from reaching the face of the unit. In addition, the strips are indicated as individual and are not interrelated in a unit to form a disposable layout form liner.

The Johnson patent (U.S. Pat. No. 3,594,968) provides a wall decoration which is formed from a plurality of frames and spacers which are adhesively attached to a wall surface. The attached frames and spacers define openings for the insertion of decorative blocks to be inserted and held to the wall surface by suitable adhesives. Additional covering strips are secured to the frames around the perimeter of the blocks. This patent does not in any way disclose the use of a disposable form liner for use in a horizontal concrete mold for the construction of a brick simulated wall panel. The panel which is shown in the Johnson patent is permanently attached and remains as part of the wall decoration.

The Salazar patent (U.S. Pat. No. 4,644,719) shows a perforated mold simulating various objects, such as bricks which is used to cast a patterned layer of settable material over a flat base layer of similar material. The mold has a plurality of strips and openings forming a lattice which is sized to fit over the entire panel. The mold has a double layer which is formed by a top layer of plastic or metal and a bottom layer having a foamed material. The foam material is stated to provide a seal to prevent leakage of the settable material which is poured into the openings to form the objects making up the top patterned layer. Texturing of the surface of the individual cast objects may be provided. Although it does not seem to say it, it is assumed that the mold is stripped from the patterned layer after the material has cured. There is nothing in this patent which teaches the use of a disposable form liner for positioning actual objects within the openings for holding and positioning these objects during the pouring of a single layer of settable material to cast an integral panel having the objects embedded in the exposed surface. The present invention has a backing sheet which holds the mold ridges in proper position for embedding the objects but does not form the objects.

The Weiner patent (U.S. Pat. No. 3,868,801) shows a simulated brick wall panel which is molded in a horizontal position. A form sheet made from a tough polymer material is provided with upstanding intersecting ridges curved at their top. Four ridges define a pocket or cavity to hold an object. A polyester settable mortar is poured into the form and is reinforced by a wire mesh grid. Foam polyurethane is then spread over the top surface of the settable material to form an insulation layer. The panels are used to form a house or other type of structure. No where in this patent is a discussion of the use of a one time, disposable, inexpensive form liner for positioning the bricks during the molding process.

The Johnson patent (U.S. Pat. No. 3,359,354) discloses a method of making preformed finished tile panels. A tile mounting board is positioned on a vibratory frame mechanism. The tile mounting board has an outer perimeter edge around the entire board to retain a settable material. Integrally formed, upwardly extending, parallel longitudinal grids and parallel transverse grids are formed on the face of the mounting board and sized to fit the individual tile pieces. Each individual pocket formed by the grids has a vacuum opening in its center portion. The tiles are positioned in each of the openings face down and held in position by a vacuum system. A settable material is poured into the mold containing the tiles and this material is allowed to set and cure to form a decorative tile panel. A resin mixture is poured into the resulting mold to encase the tiles in a rigid panel. A detailed machine is described for performing the process. The present invention is directed to a disposable, inexpensive form liner for locating the objects in the proper position during the molding of a wall panel. The form liner is stripped from the panel exposing the outer surface of the objects embedded in the panel. None of the aforesaid patents disclose any way of sealing the object in the form to prevent the settable material from contaminating the outer finished surface of the objects.

The publication entitled "Ceramic Tile Installation Methods—Practiced in Japan" (publication date unknown) discloses various ways of forming tile panels by the use of flat horizontal molds. A recessed casting bed having raised ridges for holding the tiles in position during the casting process are disclosed in this publication. It is believed that much of the disclosure which is shown in this publication is also shown and disclosed in various U.S. patents.

German patent 28 39 704, issued Mar. 27, 1980, discloses a prefabricated concrete block having a decorative surface. Natural or artificial stones are laid on a resilient pad or surface while a settable concrete mixture is poured over the natural or artificial stones. The resilient surface can be loose, granular or finely structured materials, such as sand or it can be a mat of foamed plastics, foamed rubber or mineral wool. There is no teaching in this patent of the use of a prefabricated disposable grid-like form liner to perform this function.

The Elgenstierna patent (U.S. Pat. No. 3,629,384) discloses a machine for forming composite building panels. A layer of a plastic mass is positioned in the bottom of a flat horizontal form. A plurality of objects, such as bricks properly positioned and held in place by vacuum are moved as a group above the mold and immersed into the plastic mass. The plastic mass holds the bricks in proper position while a formable or settable material is poured over the back of the bricks. A chemical releasing agent can be placed on the face of the bricks before they are immersed into the plastic mass. After the material has hardened the plastic mass or material is removed from the face of the bricks so as to leave an attractive surface appearance on the molded panel. A machine for performing this method is disclosed.

The British patent to Taylor, U.K. 491,397, discloses a molding process whereby objects are positioned in a tray having a perforated bottom. The objects, such as stones, are spaced across the perforated bottom of the tray and the tray is then immersed into a second tray having a shallow layer of molten tallow. Once the tallow has set, a cementitious mixture is poured into the tray covering the back and embedding the stones in the cementitious material. After the cementitious material has set the trays are removed and the tallow on the face and between the stones is removed.

The Scott et al. patent (U.S. Pat. No. 5,268,137) discloses the fabrication of an object retention liner for holding and retaining brick pavers along the inside surface of a vertical concrete wall form. The liner is fabricated by positioning brick pavers or other objects in recesses cast and formed in an elastomeric mold. The elastomeric mold is a permanent mold which is used for fabricating the finished object retention liner. The horizontal mold recesses have a lip or seal around the outside edge for sealing around the objects to prevent the elastomeric material for the retention liner from migrating to the back surface of the object during the casting of the final retention liner. The present invention is directed to a disposable mold liner which is fabricated from inexpensive materials which can be easily used and disposed. The Scott patent does not disclose the use of any treatment for prevention of the contamination and encrusting of the exposed face surface of the object.

SUMMARY OF THE INVENTION

The present invention is directed to a layout grid that is adhered or attached to a relatively high strength, non-stretch backing or support sheet material. A grout retarding or object protecting substance can be used to seal and protect the face surface of the object to prevent the grout from contaminating or encrusting the surface.

The grid is formed from an expanded closed cell, plastic or rubber foam material. The backing or support sheet can be formed from a cloth, plastic, or paper material having reasonable strength in both longitudinal and lateral directions. A suitable adhesive, which can be of the contact type, is applied either to the back of the grid or to one surface of the support sheet and the grid is then permanently adhered in a proper location on the backing sheet. It has been found through experimentation that strips of masking tape having widths of as small as one foot and as wide as four feet have proven to be quite satisfactory for use in the present invention. The grid is formed from a series of longitudinal and lateral ridge strips which can be cut as a one-piece integral web from a large sheet of plastic foam material. The dimension of the recesses or openings formed by the strips are sized to closely fit the intended objects, such as tiles, blocks, bricks, half bricks or brick pavers. The plastic foam, especially closed cell materials, has sufficient resilience and strength to accept the positioning of brick pavers which do not always incorporate the standard design tolerances permitted. Thus, the openings provided in the grid can stretch to accommodate slightly oversized bricks or objects. Also, it is understood that the openings can be arranged or designed to handle any number of other types of objects.

Where an adhesive coating is applied to one side of the support sheet and the application of the grid to that surface bonds the grid to the support sheet, the openings between the strips in the grid leave an area which has exposed adhesive. In one embodiment of the present invention, a paper strip having the same size as the openings is treated with a concrete retarder chemical, and then positioned in the opening so as to adhere to the adhesive. In this way, each of the openings are lined with the retarder paper to prevent the contamination of the face of the object by the concrete grout or other settable material which is used.

Where the retarder paper strip is not used, it is possible to treat the opening in the support sheet or the face of the brick paver or object with a sealant or coating which will protect the face of the brick and prevent the penetration and adherence of the contaminating grout or settable material. It has been found that a thin wax coating the face surface of the brick and possibly a portion of the sides extending from the face surface can be sprayed on the brick or object or the brick or object can be dipped in the wax before it is positioned in the layout form liner. In this way there may also be partial adhesion between the brick and the exposed adhesive on the backing or support sheet to aid in retaining the object in the layout mold liner prior to and during the molding process.

The method for making the novel layout form liner is as follows. A table is provided having a pivotally mounted cover or top having a vacuum retention system built into the cover. In this illustration the reference to a table can apply to any flat support surface upon which the layout form liner can be assembled. This could be a conventional table, continuously running conveyor, a conventional assembly line rack or any other apparatus which has sufficient area for assembling the layout form liner from individual sheets or continuous rolls. In conjunction with all of these systems is a cover or secondary assembly area capable of holding and properly positioning the grid and other materials which are then attached to the backing sheet.

As one example, the support sheet with the adhesive side facing upward is positioned on the surface of a support table. On the undersurface of a top or cover, pivotally mounted to the support table, is positioned the grid as well as retarder strips, if used. These materials are held in final position by a vacuum system. The grid and strips are then lowered into position onto the adhesive surface of the backing sheet where they are transferred and permanently adhered to the sheet. The vacuum is removed and the layout form liner is removed.

By using this method or any other similar process an inexpensive disposable layout form liner can be produced in sufficient quantities to make a commercially viable product. The according to the present invention can be used in commercial and industrial construction as well as residential and do-it-yourself projects. The layout form liner disclosed herein is primarily intended for use in a horizontal mold for positioning the objects during the casting of a suitable settable mixture, such as concrete, to form individual wall panels. The panels, in turn, are assembled to form a structure, such as a building wall or divider.

Other features and advantages of the present invention will become apparent in the following detailed description of the invention when it is considered in conjunction with the accompanying drawings.

DETAILED DESCRIPTION OF THE INVENTION

Figure 1:
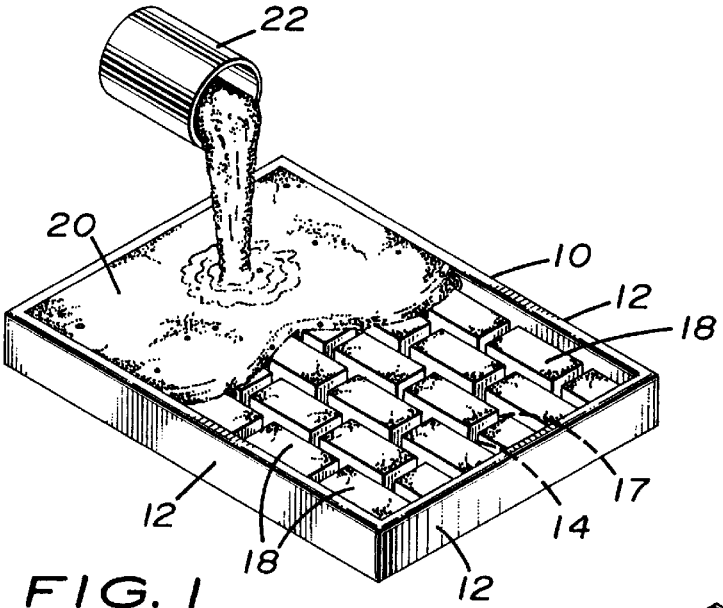
FIG. 1 shows a perspective view of a mold containing the disposable layout form liner showing the objects being embedded in a settable, pourable material.

Turning now more specifically to the drawings, FIG. 1 shows a mold or tray 10 having upwardly extending sides 12. The height of the sides 12 are predetermined to provide the thickness of the finished wall panel. The disposable layout form liner 14 is laid in the bottom of the mold 10 and is usually sized to completely cover the internal bottom area of the mold. Openings or recesses 16 are provided in the layout form liner 14 and these openings are filled with individual predetermined objects 18, such as bricks, brick pavers, tiles or blocks.

A settable, pourable material 20, such as concrete, is poured into the tray or mold 10 from a suitable source 22, such as a batch plant or concrete mixing vehicle. Concrete 20 flows around and over the bricks 18 and the layout form liner 14 so as to completely cover and submerge these items. The depth of the concrete in the mold 10 can fill the mold which, in turn will determine the width or thickness of the finished wall panel 20.

Figure 2:
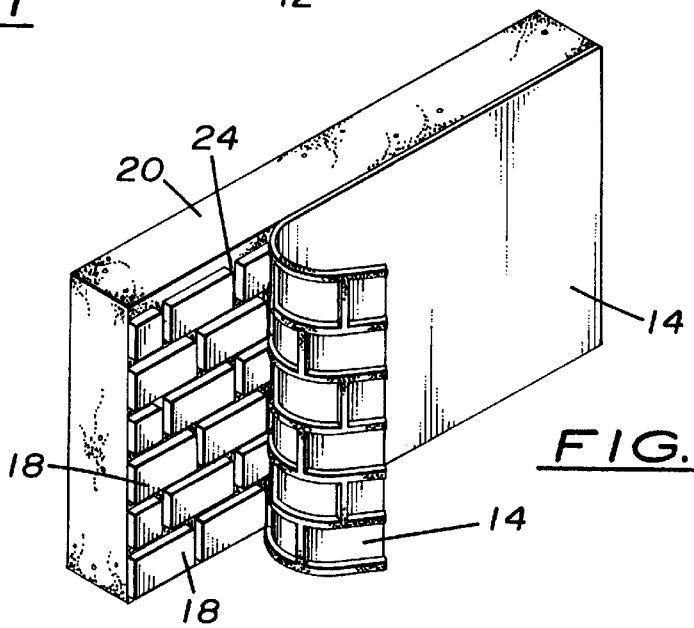
FIG. 2 is a perspective view showing the finished panel positioned upright and the partial removal of the layout form liner.
Figure 3:
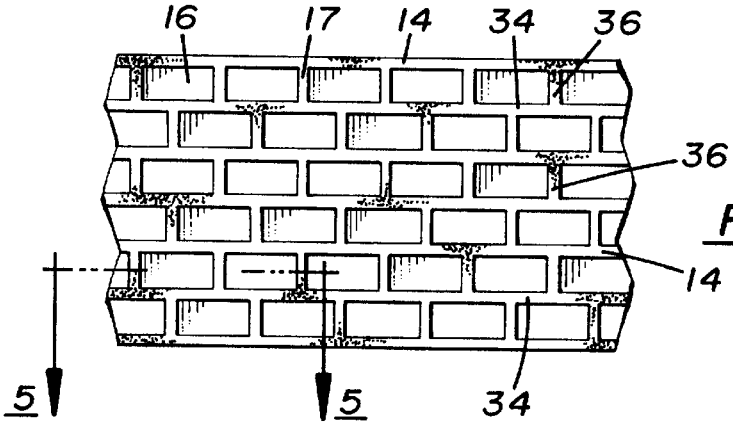
FIG. 3 is a plan view of the layout form liner according to the present invention.
Figure 4:
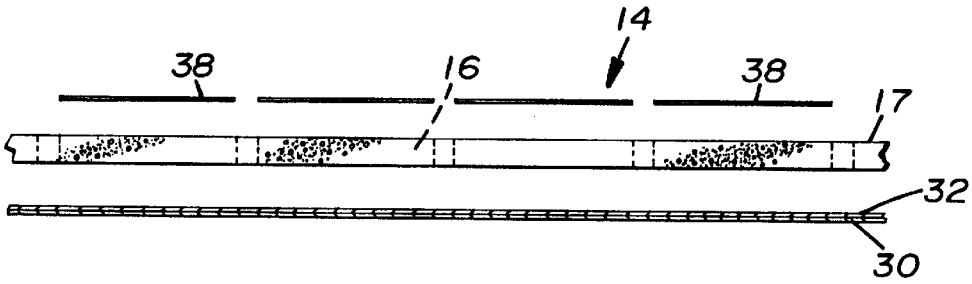
FIG. 4 is an exploded view of the components making up the form liner according to the present invention.
Figure 5:
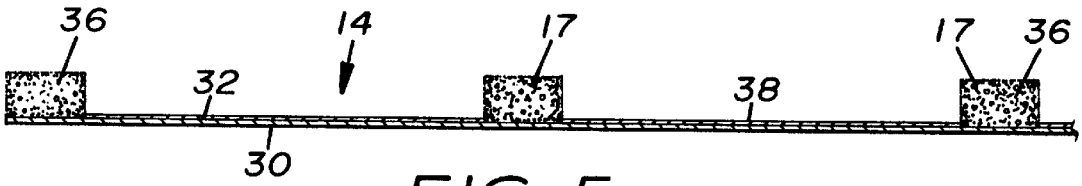
FIG. 5 is a cross-section view taken along lines 5—5 of FIG. 3.
Figure 6:
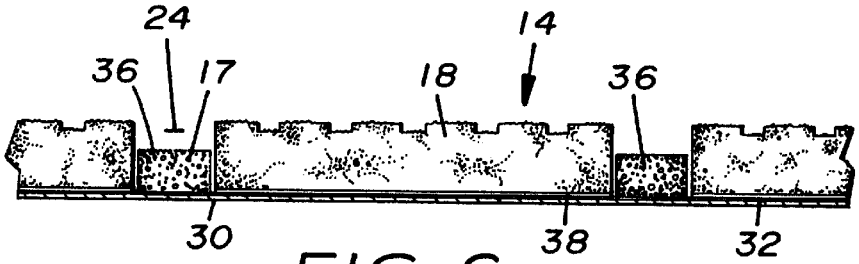
FIG. 6 is an assembled cross-section view of FIG. 5 showing bricks in place in the openings between the strips.

Once the panel 20 has set and cured, it is removed from the mold 10 and as shown in FIG. 2 can be positioned in an upright manner. The layout form liner 14 is then peeled or stripped away from the front face of the bricks 18 exposing the objects which are partially embedded. Grout lines or joint lines 24 are left between the bricks 18 which provide a simulated brick wall appearance. Because of the flexibility and strength of the layout form liner 14, it can be easily stripped from the concrete 20 making up the panel. In most cases this form liner will be damaged or destroyed during the removal from the bricks or the pouring of the concrete. Thus, the form liner is intended as a disposable one-time use product. In fact, this is one of the features which makes this product so unique and desirable.

FIGS. 3–6 show the composition of the layout form liner 14 according to the present invention. A backing or support sheet 30 fabricated from suitable materials having a relatively high tensile strength whether in a dry or wet state is provided. The support sheet material can be fabricated from either plastic, cloth, paper, or other suitable material to form a thin, lightweight sheet. A suitable adhesive 32, such as contact cement can be provided over the entire surface of one side of the sheet material 30. Experience has found that the support sheet material 30 and the adhesive 32 can be purchased as common masking tape, duct tape, or "Contact" shelf paper. Any of these types of products will work well and can be found in widths usually of one foot up to four feet or larger. It has been found that a form liner having a width of two or four feet is quite suitable for the intended purpose. It is to be understood that the width and length of the present form liner can have any dimensions desired with increments of two feet found to be quite satisfactory.

A grid 17, cut from approximately one-half inch thick sheets of closed pore polyethylene, polypropylene, polyurethane or polystyrene expanded foam plastic, can be used to form a grid usually having the same width as the support sheet. The grid 17 is made up of longitudinal strips 34 and lateral strips 36. In most cases, the strips 34, 36 form a closed opening or recess 16 which has a size which closely fits the intended object which is to be used with the specific liner 14.

In many cases, the opening 16 will be sized to closely fit the outside dimensions of a brick paver which is to be embedded in the concrete mixture. It is intended that the opening will closely fit the perimeter edges of the brick in order to provide at least a partial seal along the outside edges of the brick to prevent the seepage of grout or water to the sides and face of the brick.

The expanded foam plastic making up the grid strips 34, 36 has sufficient flexibility to allow for slight over-sizing in the dimensions of the object. In this way, various sizes can be accommodated, while in the alternative it may be necessary to cut and size the brick or object itself to bring it within the desired tolerances for these products.

A retarder paper strip 38 which is sized to correspond with the size of the opening 16 can be positioned within the opening and adhered directly to the adhesive layer 32. This paper strip is impregnated with a sugar solution which retards the curing action of the cement in the grout. This function prevents the grout from becoming bonded to the surface of the object so that it will not permanently contaminate or encrust the surface of the object. This helps greatly in the cleaning and removal of any seepage which may occur during the pouring process. It is also to be understood that the brick or object 18 can be treated with a coating of release material or given a protective coating to also prevent contamination by the water or grout from the settable mixture. If desired, a combination of a retarder paper and a coating, such as wax or other suitable chemical coating which is soluble or removable with heat or in water or a solvent, can be applied to the face surface and partially along the side edges of the object to prevent this contamination.

Figure 7:
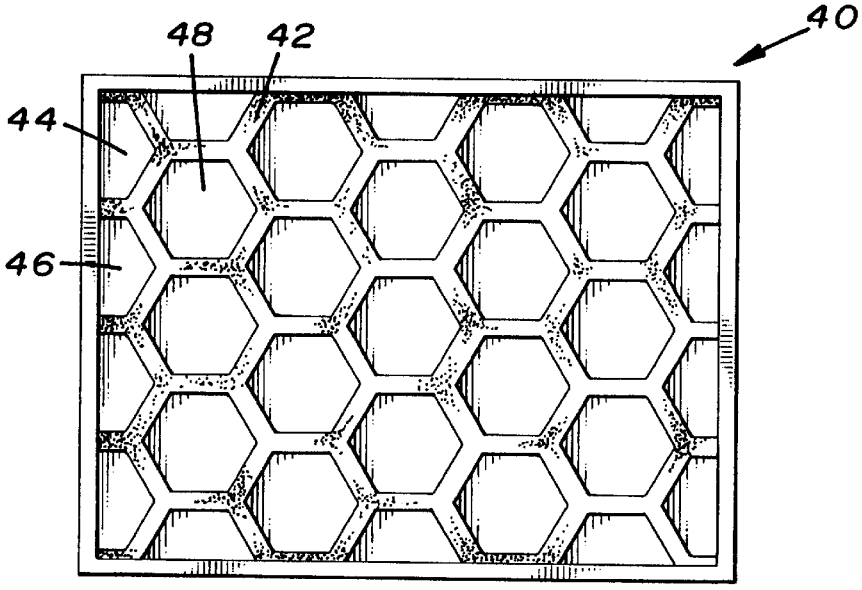
FIG. 7 is a plan view of another embodiment of the layout form liner showing the openings shaped for hexagonal tiles.

FIG. 7 shows another type of layout form liner having a different opening configuration to accommodate a different type of object, such as a hexagonal tile. The layout form liner 40 incorporates a grid 42 properly positioned and adhered to a backing or support sheet 44 which has a suitable layer of contact adhesive 46 on the upper surface. Grid 42 is fabricated from a closed cell expanded plastic foam and the openings 48 as stated above are sized to fit the intended objects. Retarder paper cut to fit the openings 48 can be inserted in these openings and adhered to the adhesive layer 46, if desired. The form liner 40 is sized to fit the bottom surface of a tray or mold and the openings 48 are filled with tiles or portions of tiles to fit the individual openings. At this point, the settable material, such as concrete is poured over the form liner as well as the objects to create the desired building panel. It is to be understood throughout this application that the openings in the grid used in forming the layout form liner as described herein can take on many different shapes depending upon the objects that are intended to be used. In addition, the height or thickness of the foamed plastic material making up the strips in the grid can be increased or decreased depending upon the objects themselves so as to provide the desired appearance as well as to seal and protect the side edges of the objects.

Figure 8:
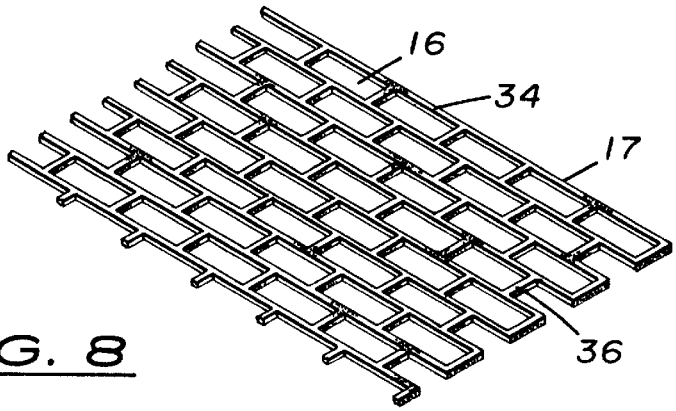
FIG. 8 is a perspective view showing the grid portion of the present invention.
Figure 9:
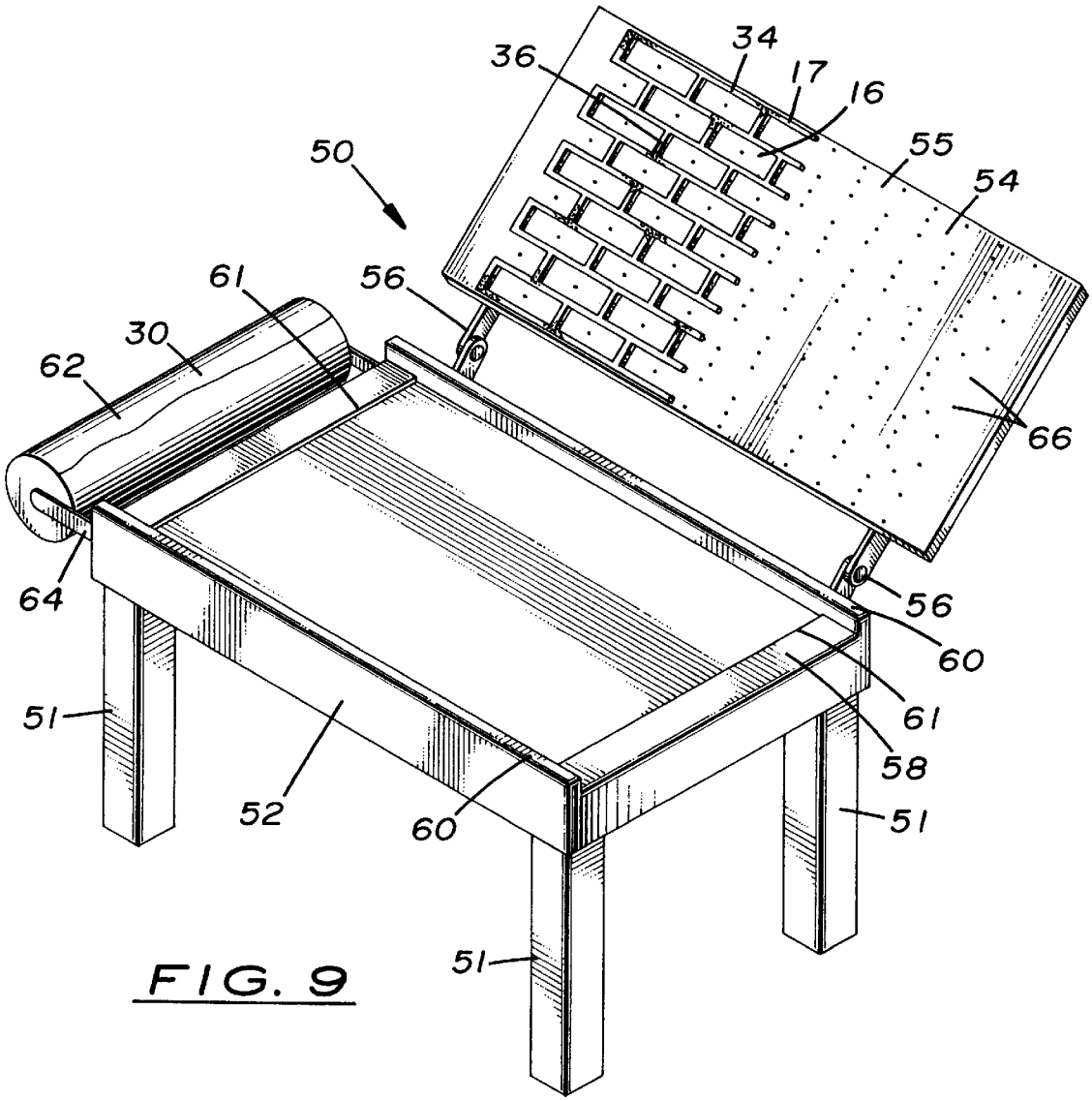
FIG. 9 is a perspective view of an assembly table and a pivotally arranged cover showing the grid held in proper position on the under surface of the cover by a vacuum system.

FIG. 8 shows a pre-formed grid 17 intended for brick pavers which is shown as a one-piece integral sheet. The grid 17 has overall outside dimensions which correspond with the desired finished layout form liner.

The following description of the present embodiment is the best mode of manufacturing the layout form liner of which the inventors are presently aware. Turning now to FIGS. 9–12, the finished layout form liner can be manufactured by the use of an assembly table 50. The assembly table 50 is composed of suitable supports or legs 51, and an assembly or base member 52 to which a cover or top 54 is pivotally attached by hinges 56. The base or assembly member 52 includes a large flat surface 58 which usually has a length which is slightly greater than the desired length of the finished layout form liner. Parallel rails 60 and guides 61 positioned on the outer edges of the assembly area 58 are spaced to provide proper positioning for the backing or support sheet 30 which makes up the finished form liner 14.

The under surface or bottom surface 55 of the top or cover 54 includes a plurality of openings 66 which communicate directly with a plurality of interconnected manifolds 68 connected by a hose 70 to a suitable vacuum source (not shown).

The grid 17 is laid up and held in proper position on the undersurface of the cover 54 by the vacuum created through the holes 66 provided in the surface. The assembly surface 58 is clear and open and is devoid of any components. A roll 62 of support sheet material 30 having a suitable adhesive layer can be stored on a pair of stanchions 64 provided at the end of the assembly area 58. If desired, precut sheets or panels having the desired finished overall dimensions can be stacked in a flat configuration near one or the other end of the assembly area 58. The support sheet can include a protective or release sheet covering the surface of the adhesive to prevent adherence to the adjacent surface of the next layer of material and also to prevent contamination.

If desired, pretreated retarder strips 38 can be positioned in each of the openings 16 of the grid 17. The retarder paper strips 38 will be held in position within the openings 16 by means of the vacuum provided through the openings 66.

Figure 10:
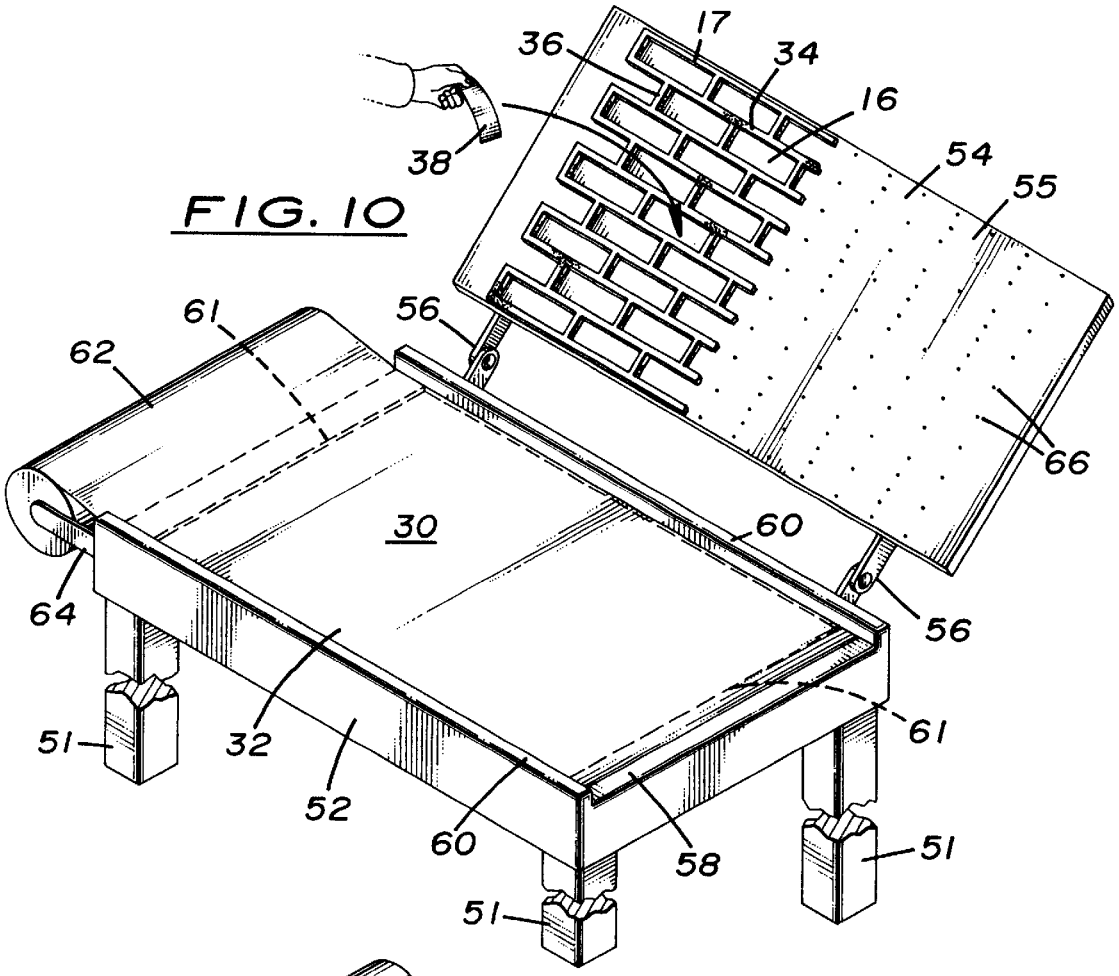
FIG. 10 is a perspective view showing the assembly area with the backing sheet with adhesive positioned on the assembly area with paper retarder strips inserted in the openings provided in the grid positioned under the cover.
Figure 11:
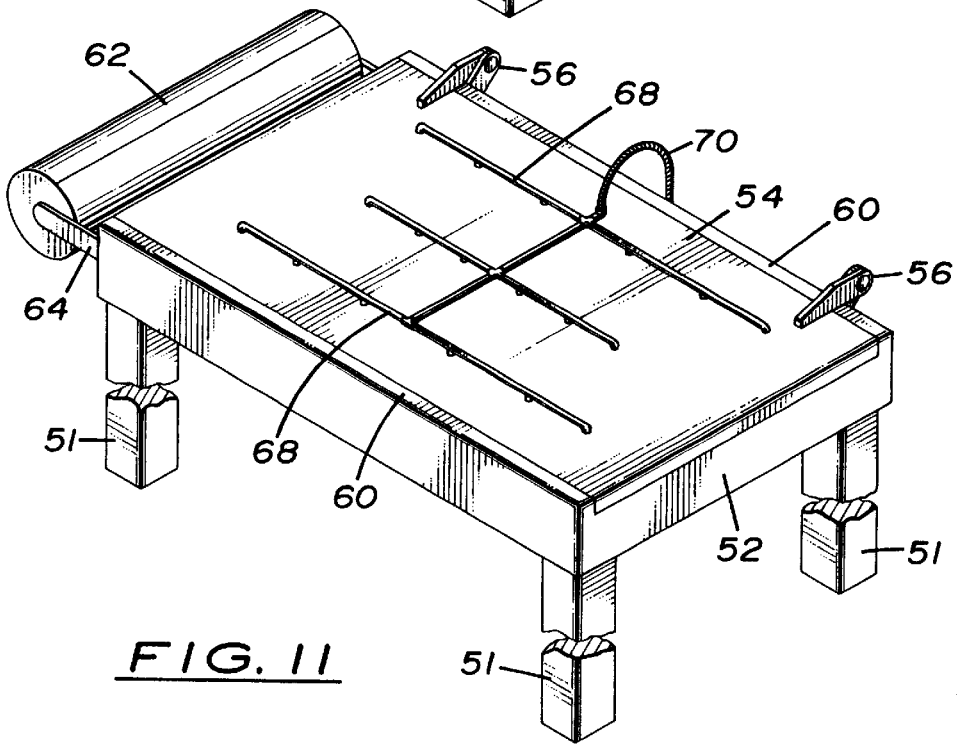
FIG. 11 is a perspective view showing the cover lowered into place on the assembly area with a vacuum manifold system mounted on the top of the cover.
Figure 12:
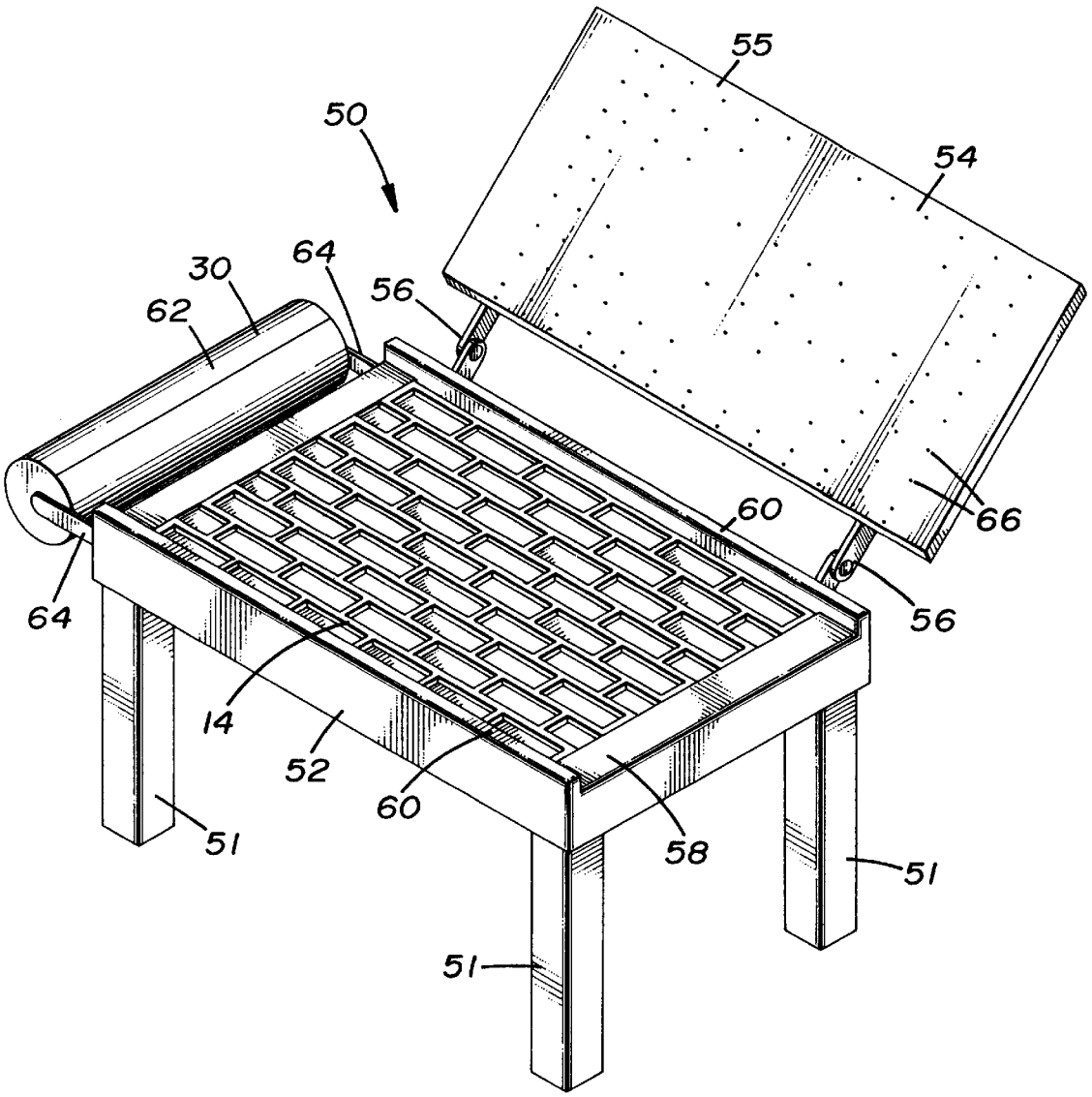
FIG. 12 is a perspective view showing the cover opened and the completed layout form liner on the assembly area.

In FIG. 10, the assembly table 50 is shown with a properly sized sheet of the support material 30 having the adhesive layer 32 lying face up and precisely positioned on the assembly area 58. As shown in the illustration, the support sheet 30 can be drawn from the roll 62 and cut to the proper length. If a release or protective sheet has been applied to the adhesive 32, it is removed to expose the adhesive 32.

Once everything has been properly positioned, the cover 54 is then pivoted downward toward the assembly surface 58 and sufficient pressure is applied so that the grid and all other items held to the undersurface 55 of the top 54 will be transferred directly to the properly positioned backing sheet 30. At this point the vacuum is shut-off and, if desired, a slight pressure can be applied to the system to release the held items and force them into complete contact with the backing sheet and its adhesive. It is also to be understood, that the adhesive layer can be omitted from the backing sheet and adhesive or glue can be applied directly to the corresponding surface of the grid and the other items immediately before assembly to properly join them to the support sheet.

Once the layout form liner has been assembled and completed it can be easily removed from the assembly area 58 and conveniently stacked for storage and transportation. These liners are very lightweight and are easily handled and transported to the job site.

In use, the layout form liner is laid in the bottom of a mold that has been fabricated to closely fit the outside dimensions of the liner. The height of the mold determines the thickness of the completed construction panel. Since the mold itself will be positioned horizontal, there is no need to attach or fasten the form liner to the bottom surface of the mold. The individual objects are then positioned to fill each of the openings 16 in the grid 17 to complete the desired pattern that will be observed in the surface of the finished construction panel.

After the bricks or objects have filled the liner a settable material, such as concrete, is poured into and fills the mold. A vibrator which is commonly used in the pouring of concrete can be used to properly disperse the concrete and fill the grout lines or spaces between the individual objects. As previously described, a retarder paper strip positioned in the openings and attached to the adhesive layer on the support sheet or a coating that can be applied directly to the adhesive layer within the openings or directly to the brick or objects is intended to protect the face surface of the bricks or objects so as to prevent the settable material from adhering permanently to the surface of the objects. This not only preserves the appearance of the face surface of the objects but also makes it considerably easier to prepare the surface of the finished structural panel.

The materials making up the assembled form liner have been specifically described and defined. It is to be understood that any type of support sheet can be used for making up the form liner according to the present invention, so long as it provides the necessary tensile strength and rigidity when being manufactured and used. As described earlier, large sized "masking tape" has been found to be quite suitable as a support sheet for the present invention. The grid can be commonly formed from a large sheet of closed cell expanded polyethylene which is manufactured and sold by Dupont as "Ethafoam" sheet gasket. Retarder papers are well known in the art and can be precut the same size as a brick face or any other object which is intended to be used. The retarder paper is essentially a paper which has been saturated in a sugar solution. By the same token, a light sugar solution can be sprayed directly on the adhesive face within the opening of the grid to accomplish the same purpose as the retarder paper. In the alternative, a chemical material can be sprayed directly on the brick or object or if desired, a coating, such as wax, paraffin or even a thin plastic coating can be applied directly to the face surface of the brick or object and along the side edges to prevent the grout or settable material from actually sticking to and contaminating the face surface of the object.

While a layout form liner for bricks or other objects and a process for making the liner has been shown and described in detail in this application, it is to be understood that this invention is not to be limited to the exact process and form disclosed and changes in the detail and construction of the apparatus may be made without departing from the spirit thereof.

What is claimed is:

1. A disposable layout form liner for positioning an object in a construction mold for pouring a settable material and producing a construction panel having a face surface with the object exposed in an outer surface of said panel, said form liner protects the face surface of the object to minimize the cleaning of the exposed surface of the finished panel, the form liner comprising;

a) thin support sheet means, said support sheet means being formed from a lightweight, tensional material;

b) grid means formed from a plurality of ridge strips arranged to intersect each other to form one or more openings which are sized to closely fit the face surface of an object, said opening being arranged to locate the object in a desired position in the finished construction panel; and c) means for joining said grid means in a predetermined location on said support sheet means.

2. A disposable layout form liner as defined in claim 1 wherein the joining means is an adhesive coating applied to a surface of the grid means for attaching the grid means directly to a surface of the support sheet means.

3. A disposable layout form liner as defined in claim 1 wherein the joining means is a thin layer of contact adhesive applied directly to a side of the support sheet means and said grid means is arranged and joined directly to the side having the adhesive layer.

4. A disposable layout form liner as defined in claim 3 wherein the openings expose the adhesive layer and strips of a settable material retarder sheet are positioned within the openings and adhered to the support sheet by the adhesive layer.

5. A disposable layout form liner as defined in claim 1 wherein the ridge strips of the grid means are formed from a single sheet of expanded foam plastic having a sufficient thickness to form a grout line in the settable material adjacent to said objects.

6. A disposable layout form liner as defined in claim 5 wherein a surface of the ridge strips opposite the support sheet means is convexly curved so as to round the finished surface of the grout line to provide a pleasing appearance.

7. A disposable layout form liner as defined in claim 1 wherein the thickness of the ridge strips forming the grid means determine the depth of a grid line formed between said objects in said construction panel.

8. A disposable layout form liner as defined in claim 1 wherein the size of the openings are slightly smaller then the dimensions of the face surface of the objects so as to create a seal between the grid means and the objects to prevent the settable material from flowing past the edges of the face surface of the objects so as to keep the face surface clean so as to eliminate the need for cleaning the exposed outer surface of the finished construction panel.

9. A disposable layout form liner as defined in claim 1 wherein the support sheet means is a sheet of paper.

10. A disposable layout form liner as defined in claim 1 wherein the support sheet means is a plastic sheet.

11. A disposable form liner as defined in claim 1 wherein the support sheet means is formed from a strip of woven material.

12. A disposable layout form liner as defined in claim 1 wherein the support sheet means is formed from masking tape.

13. A disposable layout form liner as defined in claim 1 wherein the support sheet means is formed from adhesive backed paper.

14. A disposable layout form liner as defined in claim 1 wherein a chemical retarder coating is applied to the surface of the support sheet means exposed in the openings of the grid means, said chemical retarder coating being provided so that any settable material which would pass the ridge strips in the grid means and come in contact with the face surface of the objects will not contaminate or deteriorate the face surface of the objects.

15. A disposable brick layout form liner for positioning a plurality of bricks along a bottom surface of a construction mold for pouring concrete into said mold for producing a construction panel wherein a face surface of each brick is exposed in an outer surface of said construction panel, said form liner protects the face surface of each of the bricks to minimize the necessity for cleaning of the exposed outer surface of the finished construction panel, the disposable brick layout form liner comprising:

a) a thin support sheet means having outside dimensions to fit said concrete mold, said support sheet means being formed from a lightweight, tensional material;

b) a grid means formed from a plurality of ridge strips which are arranged to intersect each other and form a plurality of openings which are sized to closely fit the bricks so as to protect a face surface and a portion of the sides of each of said bricks, said openings in said grid means being arranged to form a desired brick pattern which will be exposed in the outer surface of the construction panel; and c) means for joining said grid means in a proper location on said support sheet means.

16. A disposable brick layout form liner as defined in claim 15 wherein the joining means is a thin layer of contact adhesive which is applied to one side of the support sheet means for securely attaching the grid means to said sheet means in a proper location so as to provide the desired brick pattern appearance in the finished construction panel.

17. A disposable brick layout form liner as defined in claim 15 wherein the grid means is formed as an integral one piece sheet having a predetermined thickness which determines the depth of the grout lines between the individual embedded bricks.

18. A disposable brick layout form liner as defined in claim 15 wherein a strip of retarder paper is positioned within each grid opening and adhered to the support sheet means by a suitable adhesive whereby when a brick is positioned within the opening the concrete grout that migrates past the ridge strips in the grid means will not permanently contaminate and encrust the face surface of the bricks greatly reducing the cleaning requirements of the exposed surface of the finished construction panel.

19. A disposable brick layout form liner as defined in claim 15 wherein the support sheet means is made from masking tape and the joining means is an adhesive layer applied to one side of said tape.

20. A disposable brick layout form liner as defined in claim 15 wherein the surface of the support means exposed in the openings in the grid means is coated with a chemical solution to prevent the concrete grout which migrates to the face surface of the bricks from contaminating and encrusting these face surfaces which eliminates the need to clean the exposed outer surface of the finished construction panel.

21. A disposable brick layout form liner as defined in claim 15 which further includes a plurality of brick means which are positioned in each of the openings of said grid means, the face surface and the side edges of each of the brick means are coated with a material which prevents the concrete grout from adhering to the face surface and side edges of said brick means during the pouring of the concrete.

22. A disposable brick layout form liner as defined in claim 21 wherein each of the brick means is at least partially coated with a wax material.

23. A disposable brick layout form liner as defined in claim 18 wherein each of the brick means is at least partially coated with a chemical solution, said chemical solution preventing the concrete grout from adhering to the face surface and side edges of said brick means during the pouring of the concrete.

24. A disposable brick layout form liner for positioning a plurality of objects in a construction mold for pouring a settable material and producing a construction panel having a face surface of each of the objects exposed in an outer surface of said panel, said form liner protects the face surface of each of the objects to minimize the cleaning of the exposed outer surface of the finished construction panel, the form liner comprising;

a) thin support sheet means;

b) grid means formed from a plurality of ridge strips arranged to intersect each other to form a plurality of openings which are sized to closely fit a face surface of said objects, said openings being arranged to locate the objects in a desired pattern in the outer surface of the finished construction panel;

c) means for joining said grid means in a predetermined location on said support sheet means; and d) a chemical retarder coating is applied to the surface of the support sheet means exposed in the openings of the grid means, said chemical retarder coating being provided so that any settable material which would pass the ridge strips in the grid means and come in contact with the face surface of the objects will not contaminate or deteriorate the face surface of the objects.

25. A disposable brick layout form liner for positioning a plurality of bricks along a bottom surface of a construction mold for pouring concrete into said mold for producing a construction panel wherein a face surface of each brick is exposed in an outer surface of said construction panel, said form liner protects the face surface of each of the bricks to minimize the necessity for cleaning of the exposed outer surface of the finished construction panel, the disposable brick layout form liner comprising;

a) a thin support sheet means having outside dimensions to fit said concrete mold;

b) a grid means formed from a plurality of ridge strips which are arranged to intersect each other to form a plurality of openings which are sized to quickly fit the bricks so as to protect a face surface and a portion of the sides of each of said bricks, said openings in said grid means being arranged to form a desired brick pattern which will be exposed in the outer surface of the construction panel;

c) means for joining said grid means in a proper location on said support sheet means; and d) a plurality of brick means which are positioned in each of the openings of said grid means, the face surface and side edges of each of the brick means are coated with a material which prevents the concrete grout from adhering to the face surface and side edges of said brick means during the pouring of the concrete.

26. A disposable brick layout form liner as defined in claim 25 wherein each of the brick means is at least partially coated with a wax material.

27. A disposable brick layout form liner a defined in claim 24 wherein each of the brick means is at least partially coated with a chemical retarding solution for retarding the inherence of concrete grout.

28. A disposable brick layout form liner for positioning a plurality of bricks along a bottom surface of a construction mold for pouring concrete into said mold for producing a construction panel wherein a face surface of each brick is exposed in an outer surface of said construction panel, said form liner protects the face surface of each of the bricks to minimize the necessity of cleaning of the exposed outer surface of the finished construction panel, the disposable brick layout form liner comprising;

a) a support sheet means having outside dimensions to fit said concrete mold;

b) a grid means formed from a plurality of ridge strips which are arranged to intersect each other and form a plurality of openings which are sized to closely fit the bricks so as to protect the face surface and a portion of the sides of each of said bricks, said opening in said grid means being arranged to form a desired brick pattern which will be exposed on the outer brick surface of the construction panel;

c) a means for joining said grid means in a proper location on said support sheet means; and d) the surface of the support means exposed in the openings in the grid means is coated with a chemical retarding solution to prevent the concrete grout which migrates to the face surface of the bricks from contaminating and encrusting these face surfaces which eliminates the need to clean the exposed outer surface of the finished construction panel.

* * * * *